US007383706B1

(12) United States Patent
Mahanavanont

(10) Patent No.: US 7,383,706 B1
(45) Date of Patent: Jun. 10, 2008

(54) STRUCTURE OF A SAFETY LOCK FOR TRAVELING LUGGAGE CASES

(75) Inventor: Thavisak Mahanavanont, Kwai Chung (HK)

(73) Assignee: Thomas Mendoza International Co., Ltd., Kwai Chung, N.T. (HK)

( * ) Notice: Subject to any disclaimer, the term of this patent is extended or adjusted under 35 U.S.C. 154(b) by 0 days.

(21) Appl. No.: 11/768,201

(22) Filed: Jun. 26, 2007

(51) Int. Cl.
*E05B 65/52* (2006.01)

(52) U.S. Cl. ..... 70/69; 70/71; 70/73; 292/150; 292/153; 292/207; 292/210

(58) Field of Classification Search ..... 70/67–76; 190/101, 118–122; 292/150, 153, 173, 207, 292/210, 226
See application file for complete search history.

(56) References Cited

U.S. PATENT DOCUMENTS 3,034,327 A * 5/1962 Garmon, Jr. et al. ..... 70/70
3,162,034 A * 12/1964 Humphries ..... 70/70
3,169,788 A * 2/1965 Slan ..... 292/177
3,756,639 A * 9/1973 Wilkinson ..... 292/179
4,545,225 A * 10/1985 Mihojevich ..... 70/71
4,907,430 A * 3/1990 Hong ..... 70/312
5,943,886 A * 8/1999 Chiang ..... 70/70
7,266,980 B1 * 9/2007 Ma et al. ..... 70/69
2006/0162404 A1 * 7/2006 Hsieh ..... 70/71

* cited by examiner

*Primary Examiner*—Lloyd A. Gall
(74) *Attorney, Agent, or Firm*—Leong C. Lei

(57) ABSTRACT

A suitcase lock includes a housing forming a slot. A link bar is mounted to inside of the housing. A lid is mounted to an inner open side of the housing by the link bar pivoted to the lid. A push switch, a rotor, and a hook block are arranged on the lid. The assembled lock is mounted to a suitcase so that the hook block may engage a counterpart hook formed in an upper shell of the suitcase and a pawl of the push switch engages the lid and the rotor is set at a position abutting against the push switch to thereby prevent the upper shell from opening. When the rotor is operated so as to not abut against the push switch, the push switch is inward depressible to disengage the pawls from each other, to thereby allow the upper shell to be opened.

2 Claims, 6 Drawing Sheets

STRUCTURE OF A SAFETY LOCK FOR TRAVELING LUGGAGE CASES

BACKGROUND OF THE INVENTION (a) Technical Field of the Invention

The present invention relates to a suitcase lock, and in particular to a suitcase lock that is easily operated to efficiently open/close the suitcase without using a key.

(b) Description of the Prior Art

A conventional suitcase, as illustrated in FIG. 1, comprises a body 1 having a front middle section in which a combination lock 11 with a key lock 12 is provided and two opposite portions to each of which a latch lock 13 is mounted. Apparently, the conventional suitcase has at least tree locks 12 and 13. This definitely ensures security and protection of the suitcase body 1 against undesired or unexpected opening of the suitcase due to collision or movement. However, in clearing customs, the suitcase owner must use two keys to respectively release the locks 12, 13. This is time consuming, and often causes troubles when the keys are lost, under which condition, the only way to open the suitcase is to break in the suitcase. This certainly causes damage to the suitcase owner.

Thus, the present invention is aimed to provide a suitcase lock to overcome the drawbacks of the conventional suitcase lock discussed above.

SUMMARY OF THE INVENTION

The primary purpose of the present invention is to provide a suitcase lock, which allows a suitcase to be locked or unlocked with simple operation by bare hands without using keys to thereby enhance utility of the suitcase.

To achieve the above objective, the present invention provides a suitcase lock comprising an elongate housing having a surface in which a slot is defined. A link bar is mounted to inside of the housing. A lid is mounted to an inner open side of the housing by the link bar pivoted to the lid. A push switch, a rotor, and a hook block are arranged on the lid. The assembled lock is mounted to a suitcase so that the hook block may engage a counterpart hook formed in an upper shell of the suitcase and a pawl of the push switch engages the lid and the rotor is set at a position abutting against the push switch to thereby prevent the upper shell from opening. When the rotor is operated so as to not abut against the push switch, the push switch is inward depressible to disengage the pawls from each other, to thereby allow the upper shell to be opened.

In the suitcase lock, the pawl of the push switch is formed at an inner surface thereof and the lid is provided with a corresponding pawl. The push switch partially projects beyond an open end of the housing with an end thereof. Thus, when the upper shell of the suitcase is closed, the pawls engage each other to close the upper shell.

In the suitcase lock, the rotor forms a projection block and a plate set at a predetermined angular position with respect to the projection block. The plate extends beyond the housing through the slot of the housing for being manually operated to move the rotor to a position abutting against the push switch or to separate the rotor from the push switch.

In the suitcase lock, the hook block forms a hook and the hook block has an inner surface forming a recess for accommodating a spring which biases the hook block in a given direction so that the suitcase can be locked or unlocked by the counterpart hook of the upper shell engaging/disengaging the hook of the hook block.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
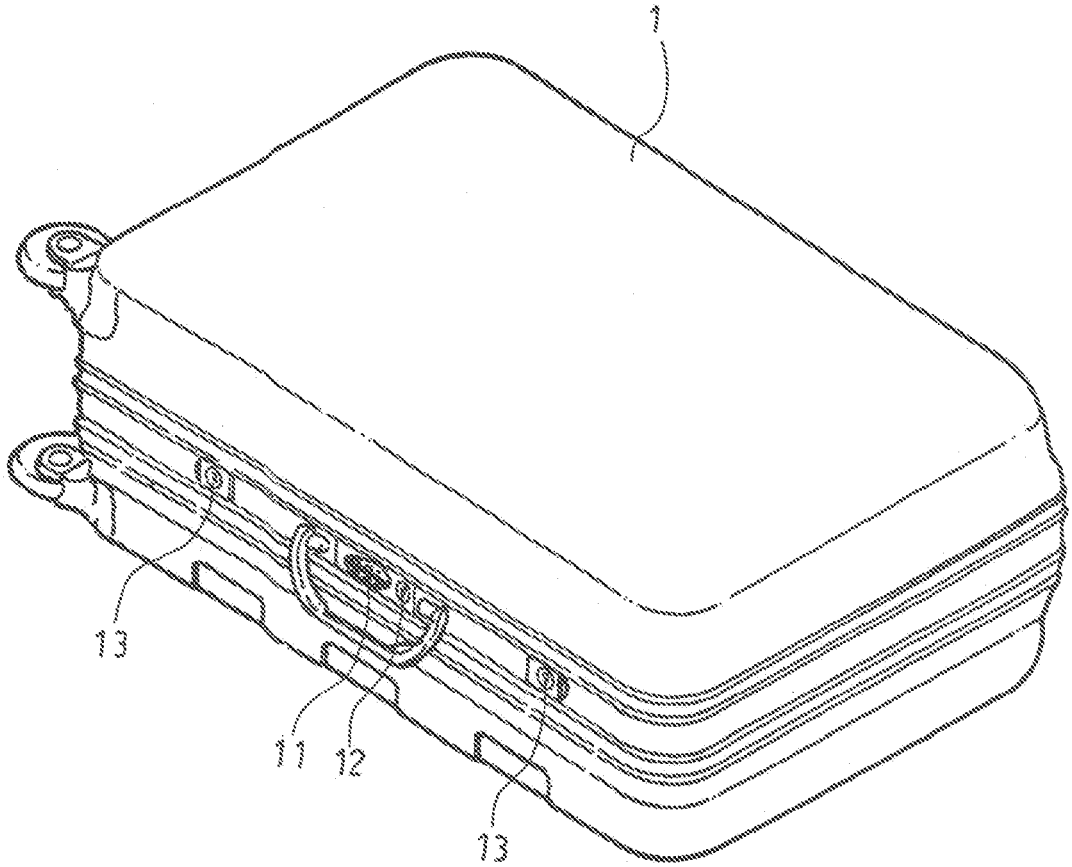
PRIOR ART FIG. 1
FIG. 1 is a perspective view of a conventional suitcase.
Figure 2:
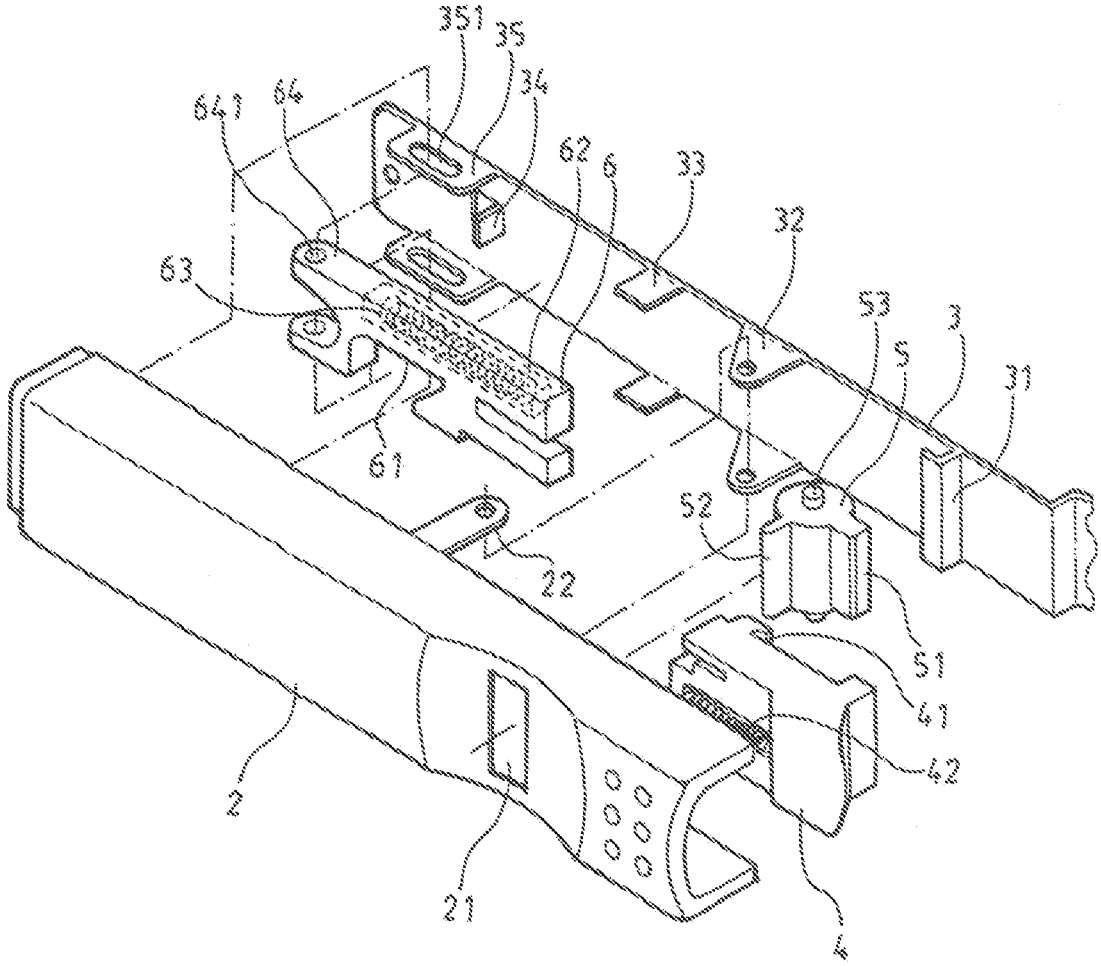
FIG. 2 is an exploded view of a suitcase lock constructed in accordance with the present invention.
Figure 3:
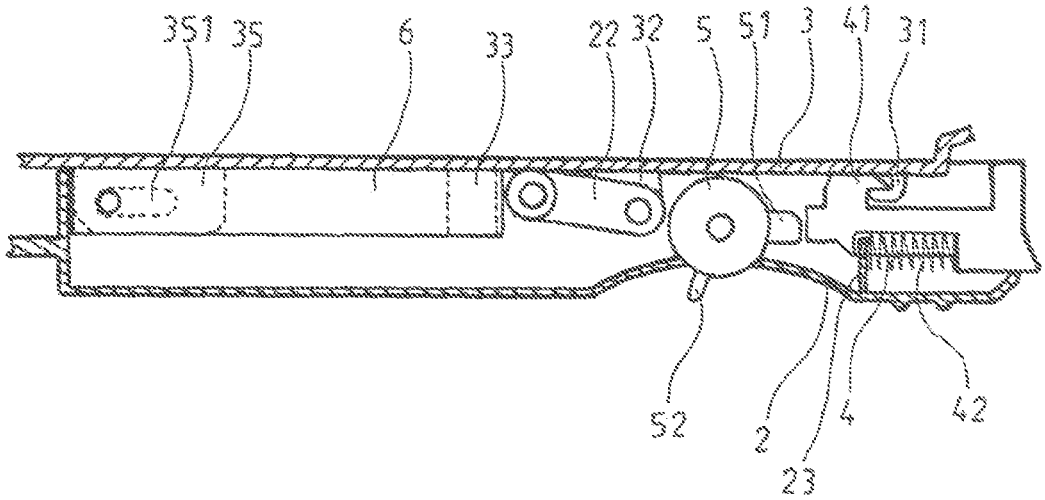
FIG. 3 is a cross-sectional view of the suitcase lock of the present invention.

With reference to the drawings, and in particular to FIGS. 2 and 3, a suitcase lock constructed in accordance with the present invention comprises an elongate housing 2, a lid 3, a push switch 4, a rotor 5, and a hook block 6. The housing 2 has a surface extending in a lengthwise direction and forming a slot 21 that extends in a widthwise direction perpendicular the length of the housing 2. A link bar 22 is fixed, preferably in a rotatable manner, inside the housing surface.

The lid 3 is mounted to the housing 2 and covers an open inner side of the housing 2. One the surface of the lid 3 facing the housing 2, a first pawl 31 is formed at a lengthwise end section of the lid 3. Also on the surface of the lid 3 facing the housing 2, two lug 32 and two mounting tabs 33, both being symmetrically arranged, are formed along middle sections of opposite lengthwise edges of the lid 3. The link bar 22 of the housing 2 is pivotally connected to the lugs 32. Provided at an opposite end section of the lid 3 is a retention plate 34 and two positioning plates 35. The positioning plates 35 are preferably formed along the lengthwise edges of the lids in a symmetric manner. The positioning plates 35 form extended holes 351 and a lengthwise end of the housing 2 is rotatably coupled to the extended holes 351 of the positioning plates 35.

The push switch 4 is movably mounted inside the housing 2 at an opposite lengthwise end, which is open so as to allow partial projection of the push switch 4 out of the housing 2 to be accessed by a user. An inner surface of the push switch 4, which faces the lid 3, is provided with a second pawl 41 corresponding and engageable with the first pawl 31 of the lid 3. An outer surface of the push switch 4 is provided with a spring 42, which has an end fixed to a retention plate 23 that is mounted inside the housing 2, whereby the spring 42 biases the push switch 4 in a locked condition, where the first and second pawls 31, 41 engage each other.

The rotor 5 is in a cylindrical form in the embodiment illustrated, having an outer circumference on which a projection block 51 is formed. Also formed on the outer circumference of the rotor 5 is a plate 52 that is set at a predetermined angular position with respect to the projection block 51. The rotor 5 also has axially aligned pivots 53 for rotatably supporting the rotor 5 inside the housing 2 with the plate 52 extending beyond the housing 2 through the slot 21.

The hook block 6 is arranged inside the housing 2 and inboard the mounting tabs 33 of the lid 3 and is fixed by the mounting tabs 33. The hook block 6 forms a hook 61. The hook block 6 has an inner surface in which a recess 62 is defined for accommodating a spring 63. Formed at an end of the hook block 6 are two symmetrically arranged lugs 64, which forms aligned through holes 641. The hook block 6 is rotatably mounted to the extended holes 351 of the positioning plate 35 of the lid 3 by the lugs 64 with an end of the spring 63 abutting against the retention plate 34.

With the combination of the above described components, a suitcase lock is provided. In practice applications, two such suitcase locks are mounted to a front face of a lower shell of a suitcase, at symmetric opposite portions of the front face. Thus, when an upper shell is closed to the lower shell, the hooks 61 of the hook blocks 6 of the two suitcase locks engage counterpart hooks formed on the upper shell of the suitcase. Also, the second pawl 41 of the push switch 4 engages the first pawl 31 of the lid 3 and the rotor 5 is set at a position to abut against the push switch 4 so that the upper shell is fixed to the lower shell and is prevented from opening whereby the suitcase is locked. On the other hand, when the rotor 5 is moved away from the set position by being manually operated with the plate 52, the rotor 5 no longer abuts against the push switch 4 and the push switch 4 is now manually depressible to disengage the second pawl 41 from the first pawl 31 of the lid 3 thereby allowing the upper shell of the suitcase to be separated from the lower shell to open the suitcase.

Figure 4:
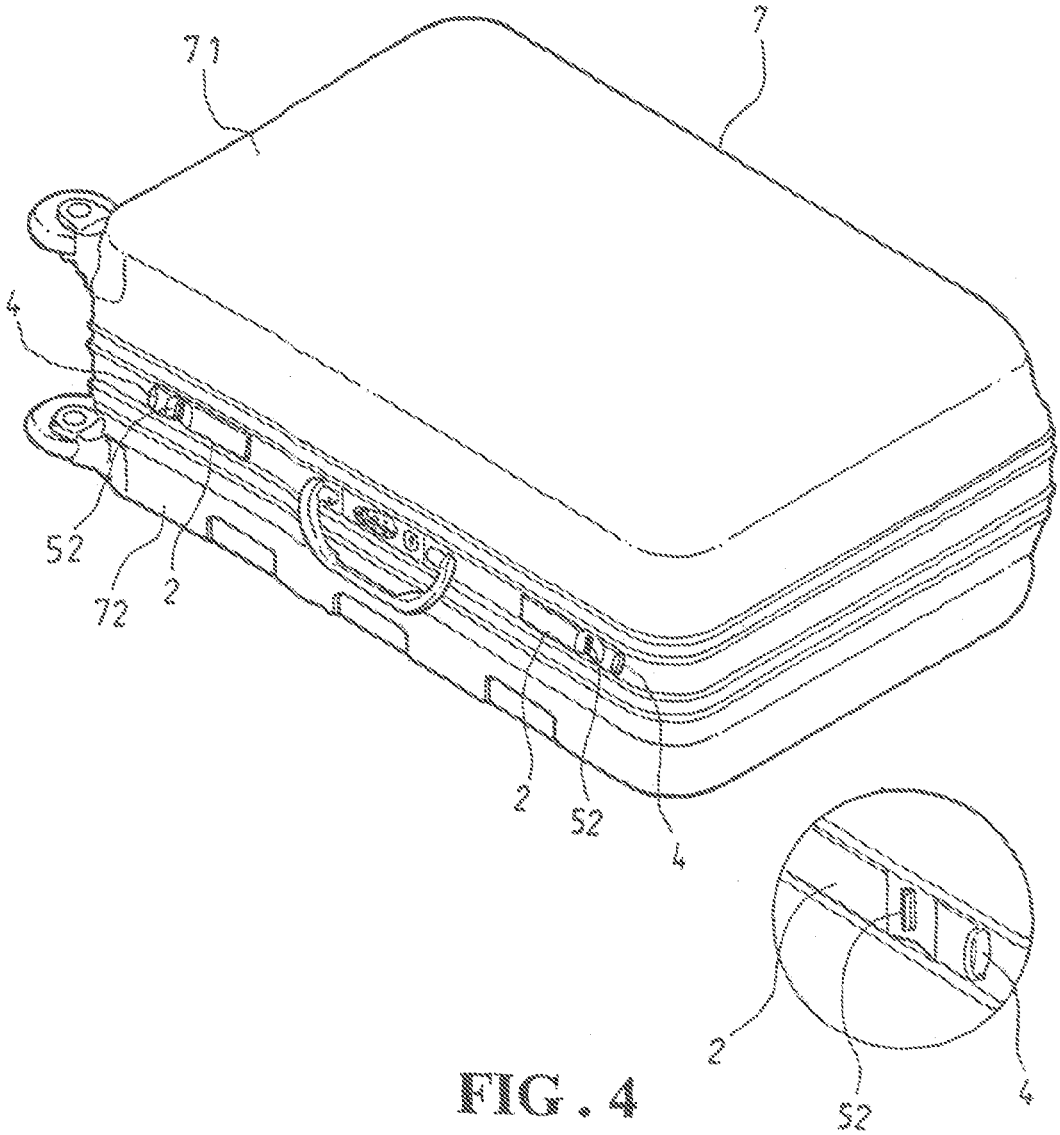
FIG. 4 is a perspective view illustrating a suitcase in which the suitcase lock of the present invention is mounted, the suitcase lock being in a locked condition.
Figure 5:
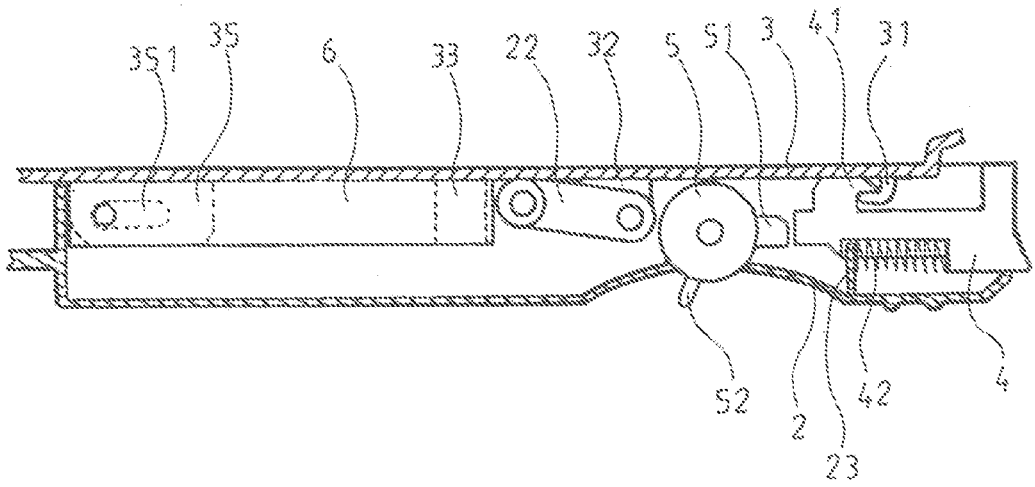
FIG. 5 is a cross-sectional view illustrating the suitcase lock of the present invention in a locked condition.

Also referring to FIGS. 4 and 5, in practice applications, two such suitcase locks are mounted to opposite portions on a front face of a lower shell 72 of a suitcase 7 in a symmetric manner. When an upper shell 71 of the suitcase 7 is closed, the housing 2 of each suitcase lock is depressed in a direction toward the suitcase 7 and the hook block 6 is moved to have the hook 61 thereof engage a counterpart hook formed on the upper shell 71. The rotor 5 is then operated by manually forcing the plate 52 thereof in a direction toward to the push switch 4 to have the projection block 51 of the rotor 5 set a position substantially aligning with and abuttingly engaging the push switch 4. Thus, the push switch 4 is prevented from being pushed inward and the upper shell is locked and not openable.

Figure 6:
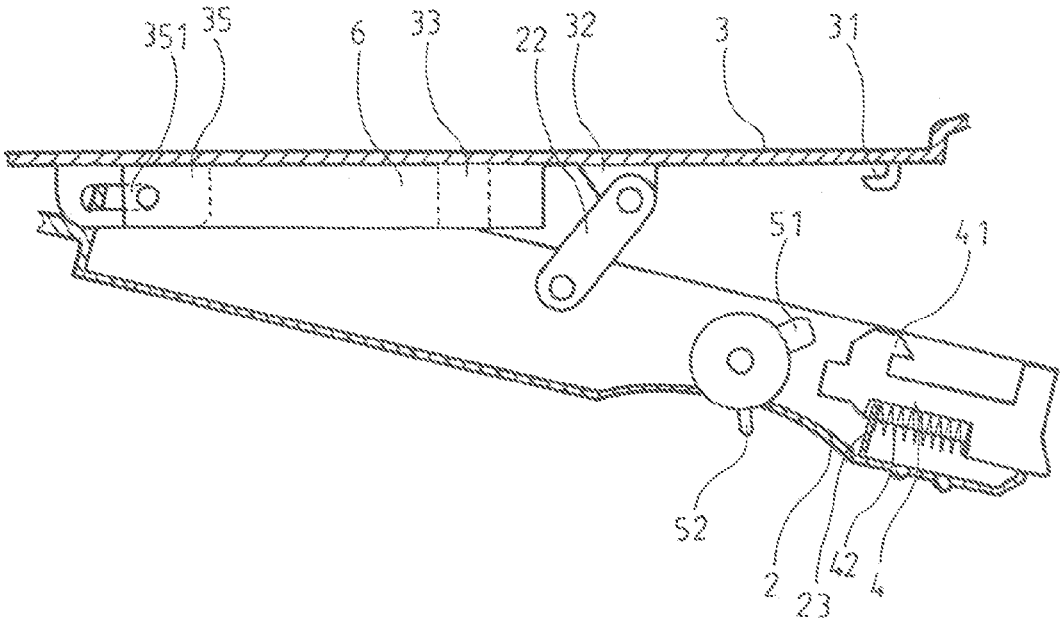
FIG. 6 is a cross-sectional view illustrating the suitcase lock of the present invention in an open condition.
Figure 7:
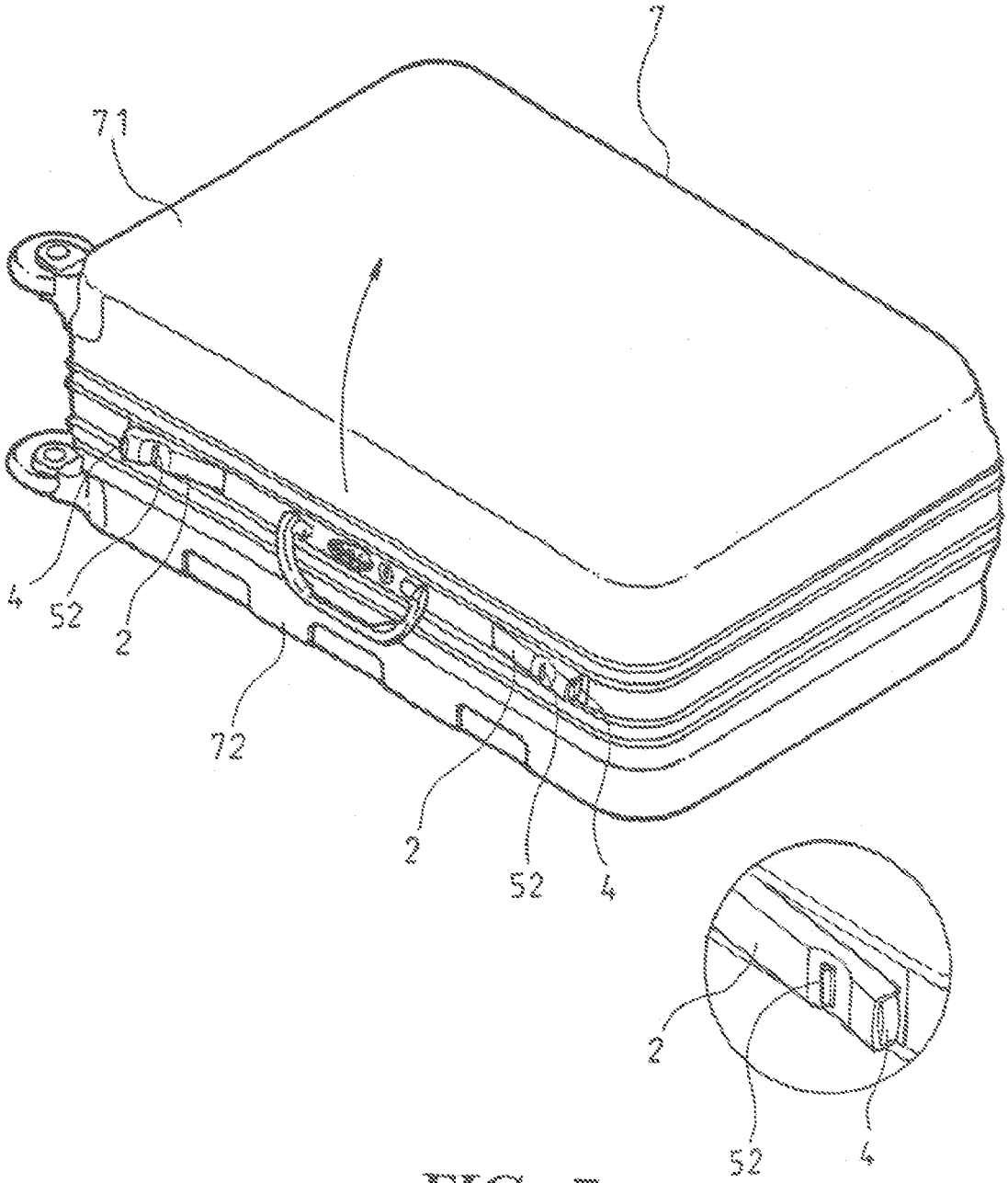
FIG. 7 is a perspective view illustrating a suitcase in which the suitcase lock of the present invention is mounted, the suitcase lock being in an unlocked condition.

Also referring to FIGS. 6 and 7, to open the upper shell 71 of the suitcase 7, the plate 52 of the rotor 5 is moved in a direction toward middle of the suitcase to break the abutting engagement between the projection block 51 and the push switch 4. This allows the push switch to be inward depressible to also disengage the second pawl 41 thereof from the first pawl 31 of the lid 3. The hook block 6 is biased by the spring 63 to disengage from the counterpart hook of the upper shell 71 to restore the upper shell 71 back to an openable condition. Once the upper shell 71 is opened, the push switch 4 returns to original position by the biasing force of the spring 42.

Although the present invention has been described with reference to the preferred embodiment thereof, it is apparent to those skilled in the art that a variety of modifications and changes may be made without departing from the scope of the present invention which is intended to be defined by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A suitcase lock comprising:

a housing having a surface in which a slot is defined, a link bar being mounted inside the housing;

a lid mounted to an inner open side of the housing having an end section on which a first pawl is formed, a middle section forming lugs to pivotally connect the link bar of the housing, and an opposite end section forming a retention plate and positioning plates, the positioning plates defining extended holes to rotatably joint an end of the housing;

a push switch arranged at and partially projecting beyond an open end of the housing, the push switch having an inner surface forming a second pawl corresponding to and engageable with the first pawl of the lid;

a rotor forming a projection block and a plate set at a predetermined angular position with respect to the projection block, the rotor having pivots for mounting to the housing to allow the plate projecting outward through the slot of the housing; and a hook block arranged at the opposite end section of the lid and forming a hook, the hook block having an inner surface in which a recess is formed to accommodate a spring, the hook block forming lugs at an end and the lugs forming through holes to allow the hook block to pivotally connect to the extended holes of the positioning plates of the lid with an end of the spring abutting against the retention plate;

wherein the suitcase lock is adapted to be mounted in pair to opposite positions of a lower shell of a suitcase so that when an upper shell of the suitcase is closed, the hook of the hook block engages a counterpart hook of the upper shell, and the second pawl of the push switch engages the first pawl of the lid and the rotor is set at a position to abut against the push switch to thereby prevent the upper shell from opening and wherein when the rotor is moved away from the set position by being manually operated with the plate and no longer abutting against the push switch, the push switch is manually depressible to disengage the second pawl thereof from the first pawl of the lid thereby allowing the upper shell of the suitcase to be openable.

2. The suitcase lock as claimed in claim 1, wherein the lid comprises symmetrically arranged mounting tabs, the hook block being received between the mounting tabs for positioning.

* * * * *